US005657942A

United States Patent [19]

Faulk

[11] Patent Number: 5,657,942

[45] Date of Patent: Aug. 19, 1997

[54] INDUCTORS AND INDUCTOR WINDING SCHEME

[75] Inventor: Richard A. Faulk, Cypress, Tex.

[73] Assignee: Compaq Computer Corporation, Houston, Tex.

[21] Appl. No.: 366,232

[22] Filed: Dec. 28, 1994

[51] Int. Cl.[6] ..... H01F 41/06

[52] U.S. Cl. ..... 242/443.1; 140/92.2

[58] Field of Search ..... 242/7.11, 7.13, 242/7.08, 7.09; 140/92.2

[56] References Cited

U.S. PATENT DOCUMENTS

| | | | |
|---|---|---|---|
| 535,105 | 3/1895 | Heath | 140/92.2 |
| 1,965,330 | 7/1934 | Apple | 140/92.2 |
| 2,388,598 | 11/1945 | Cahill | 140/92.2 |
| 2,479,391 | 8/1949 | Miller | 140/92.2 |
| 2,930,014 | 3/1960 | Van der Hoek et al. | 140/92.2 |
| 3,337,145 | 8/1967 | Keck | 242/7.11 |
| 3,635,411 | 1/1972 | Petrinjak et al. | 242/7.11 |
| 3,858,624 | 1/1975 | Sallin | 140/92.2 |

OTHER PUBLICATIONS

Green et al., Seminar 8, "Ferrites: Tips, Traps, Techniques & Trends".

Professsion Education Seminars Workbook from APEC'92 Seventh Annual Applied Power Electronics Conference and Exposition Feb. 23–27, 1992, Westin Hotel – Copley Place, Boston, Massachusetts.

Vollin et al., "Magnetic Regulator Modeling," pp. 604–611, no date.

Conference Proceedings 1993 from APEC'93 Eighth Applied Power Electronics Conference and Exposition Mar. 7–11, 1993, Town & Country Hotel, San Diego, California.

Dai et al., "A Comparative Study of High–Frequency Low–Profile Planar Transformer Technologies," pp. 153–161.

1993 VPEC Seminar Proceedings from The Eleventh Annual Power Electronics Seminar Sep. 19–21, 1993 Virginia Tech, Blacksburg, Virginia.

*Primary Examiner*—Katherine Matecki

*Attorney, Agent, or Firm*—Fish & Richardson P.C.

[57] ABSTRACT

A winding arbor comprises two plates defining a predefined winding gap between them and a center post extending between the two plates. One of the plates has a hole for feeding a wire from one side of the plate to the space between them and a groove for receiving the wire. The groove extends angularly from the hole to the perimeter of the plate.

18 Claims, 9 Drawing Sheets

INDUCTORS AND INDUCTOR WINDING SCHEME

BACKGROUND

This invention relates to inductors and inductor winding schemes.

An inductor has a core and a winding around the core. By inductor we mean to include devices that have only a single winding and others, like transformers, that have more than one winding. When the inductor is to be mounted on a printed circuit board in an application where space is at a premium, it is important to have the inductor occupy only a minimum area on the board and only a minimum overall volume of space. Inductors for such applications typically include a header or carrier with a plastic bobbin around which the windings are wrapped.

One known way to reduce the volume of an inductor is to form the windings as planar elements either directly on the printed circuit board, or on a mylar substrate which may be folded to create the winding.

SUMMARY OF THE INVENTION

In general, in one aspect, the invention features a winding arbor having two plates defining a predefined winding gap between them and a center post extending between the two plates. One of the plates has a hole for feeding a wire from one side of the one plate to the space between them and a groove for receiving the wire. The groove extends angularly from the hole to the perimeter of the plate.

Implementations of the invention include the following features. The winding arbor may be made of a high tolerance material. The center post may be shaped complimentary to the desired winding. A retainer may be used to secure the wire to the arbor. A screw and screw hole assembly may maintain the two plates in position. A shaft may extend opposite the center post. The shaft may be mounted in the chuck of a winding machine. The hole may be angled. The groove may be angled to about 30°.

In general, in another aspect, the invention features a cascaded arbor assembly having two arbor portions having respective parallel surfaces, and a center post fixed on one of the arbor portions. The center post and one arbor portion are movable back and forth to mate and unmate the center post with a hole in the other arbor portion.

Implementations of the invention include the following features. A motor may be connected to one end of the assembly. An actuator may be used for retracting the center post. A brake may be included for stopping movement of the assembly. The two arbor portions may rotate about a shaft. The shaft may be slidably connected to a drive shaft. The center post may move back and forth by a spring.

The inductor winding scheme is useful for making free-standing wire windings for the inductor. The winding arbor is cost efficient, easy to assemble, and may be used manually or with a winding machine. The winding arbor allows wires to be easily taped together without being abraded. The winding arbor is adjusted to create windings of a precise depth.

The cascaded arbor assembly is useful for winding free-standing wires of any gauge such as for use in low-profile inductors. Individual winding arbors are cascaded together to easily load, wind, and eject wire windings. Numerous windings may be created at once with the same precision. A single motor is needed to power a series of winding arbors at the same time.

Other advantages and features will become apparent from the following description and from the claims.

DETAILED DESCRIPTION

Figure 1:
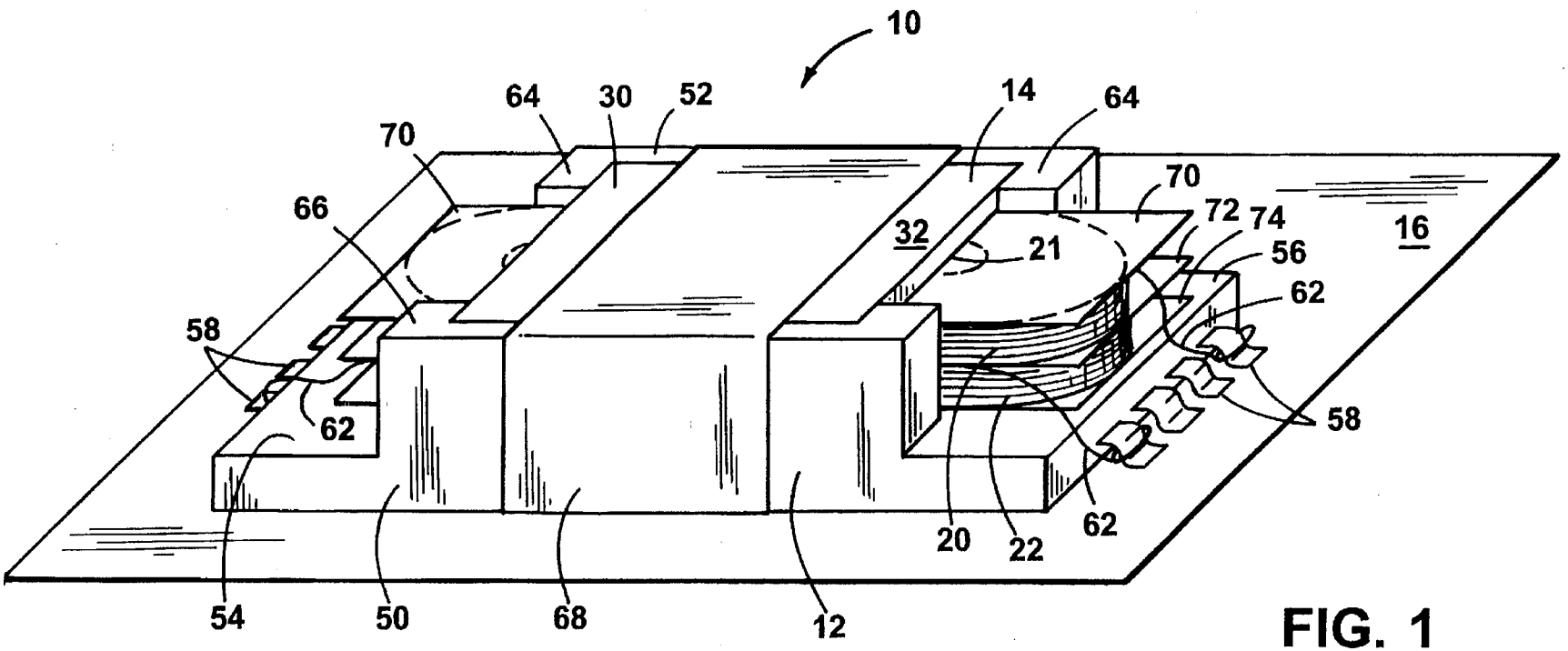
FIGS. 1 through 5 are a perspective view, exploded view, top view, side view, and rear view, respectively, of an inductor assembly.

In the inductor assembly 10 of FIGS. 1–5, a header or carrier 12 supports an inductor 14 on a printed circuit board 16. The inductor 14 includes an E-shaped core bottom 18, which supports first and second windings 20 and 22. The E-shaped core bottom includes two outer walls 24 and 26 and an inner wall 28. Walls 24, 26 and 28 are the same height. A core top 30 covers and sandwiches the windings 20 and 22 within the inductor 14. The windings 20 and 22 are separated by insulating layer 72. Winding 20 and core top 30 and winding 22 and core bottom 18 are also separated by insulating layers 70 and 74, respectively. The bottom surface of the core top 30 is directly in contact with insulating layer 70, which is directly in contact with the top surfaces 34, 35 and 36 of the walls 24, 26 and 28 of the core bottom 18. Insulating layer 70 forms a gap 21 between the core top 30 and the core bottom 18. There is no free space left between any of the pieces of the sandwich of windings and insulating layer. Alternatively, lower wall 28 is shorter than outer walls 24 and 25 to form gap 21 between core top 30 and core bottom 18.

Figure 6:
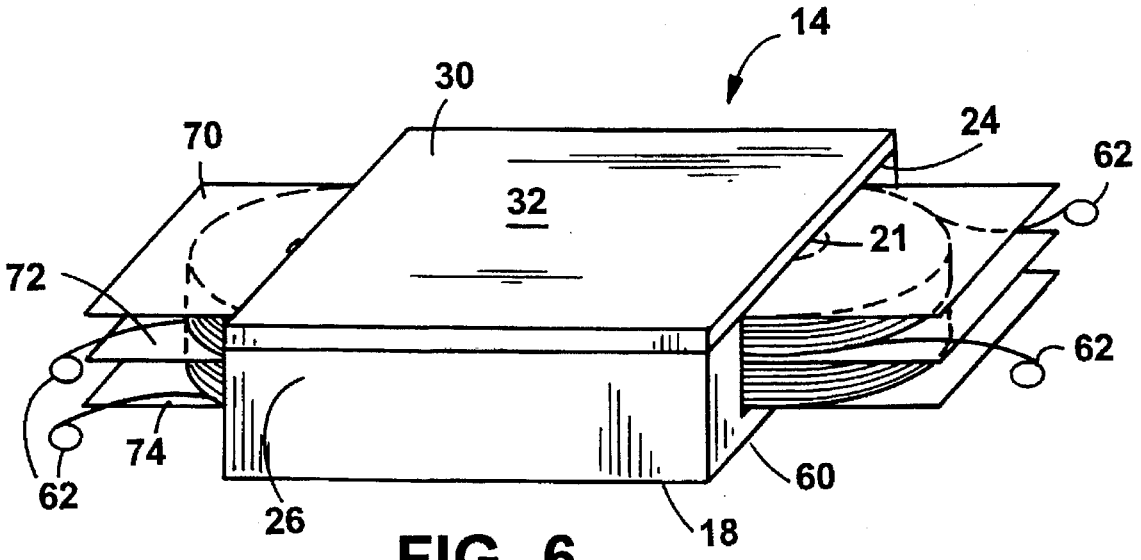
FIG. 6 is a perspective view of an inductor.
Figure 7:
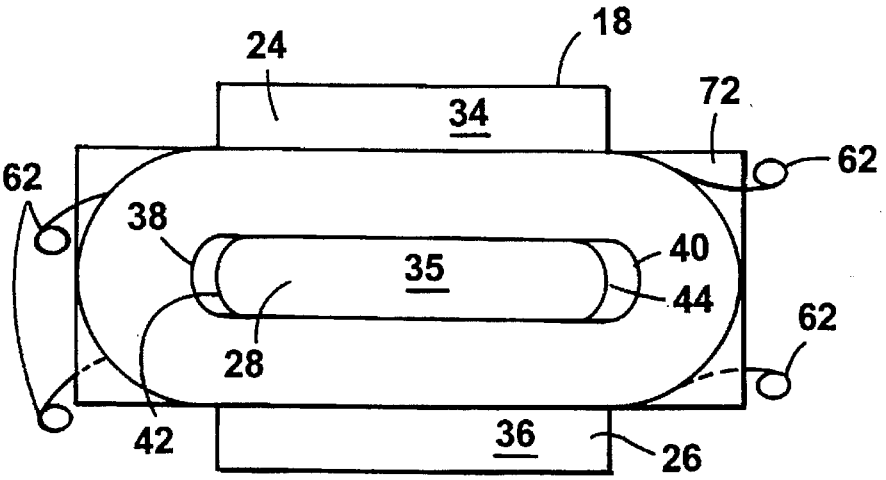
FIG. 7 is a top view of the core bottom and windings of an inductor.
Figure 8:
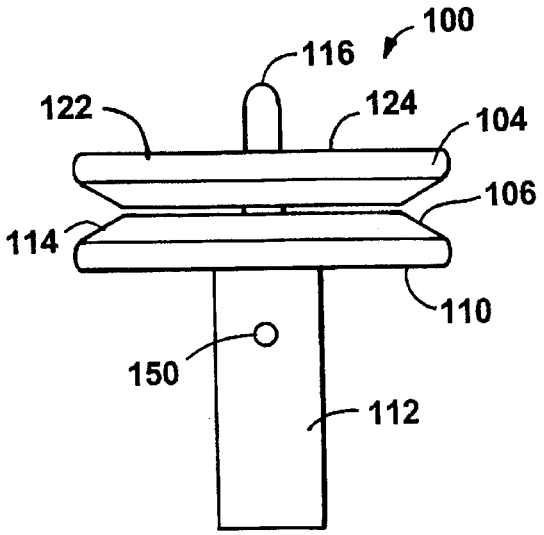
FIG. 8 is a side view of a manual winding arbor.

Referring also to FIGS. 6 and 7, windings 20 and 22 are elliptical and are configured to be held tightly within the E-shaped core bottom 18 leaving as little free space as possible between the windings 20 and 22 and the core walls 24 and 26. Windings 20 and 22 fit around the inner wall 28. The corners of inner prong 28 are rounded to keep tolerance losses down and to prevent damaging windings 20, 22 during manufacture. Spaces exist between the inner curved surfaces 38 and 40 of the windings 20 and 22 and the ends 42 and 44 of inner wall 28. When the windings 20, 22 are placed between the core top 30 and core bottom 18, the ends 46 and 48 of the windings 20 and 22 project beyond the ends of core top and bottom 30 and 18.

The header 12 includes supporting side walls 50 and 52 and platforms 54 and 56. The supporting side walls 50 and 52 include fingers 64 and 66 which hold the inductor 14 in place and support it. The supporting walls 50, 52 of header 12 are as thin as possible to maintain the structural integrity during the assembly of inductor assembly 10 (the proportions shown in Figures are not necessarily to scale). The platforms 54 and 56 support one or more electrical contacts or terminals 58 which are preformed and fixed to the header 12. The windings 20 and 22 of the inductor 14 include one or more leads 62 which connect to the terminals 58 of the header 12. The inductor 14 fits tightly within the side walls 50 and 52 of the header 12. The header 12 does not include a bottom surface, so that when the inductor assembly 10 is mounted on printed circuit board 16 the bottom surface 60 of the inductor 14 is directly in contact with the printed circuit board 16 in region 17 (see FIG. 2). Because the inductor 14 is directly in contact with printed circuit board 16, the inductor assembly 10 has a low profile relative to printed circuit board 16.

Figure 2:
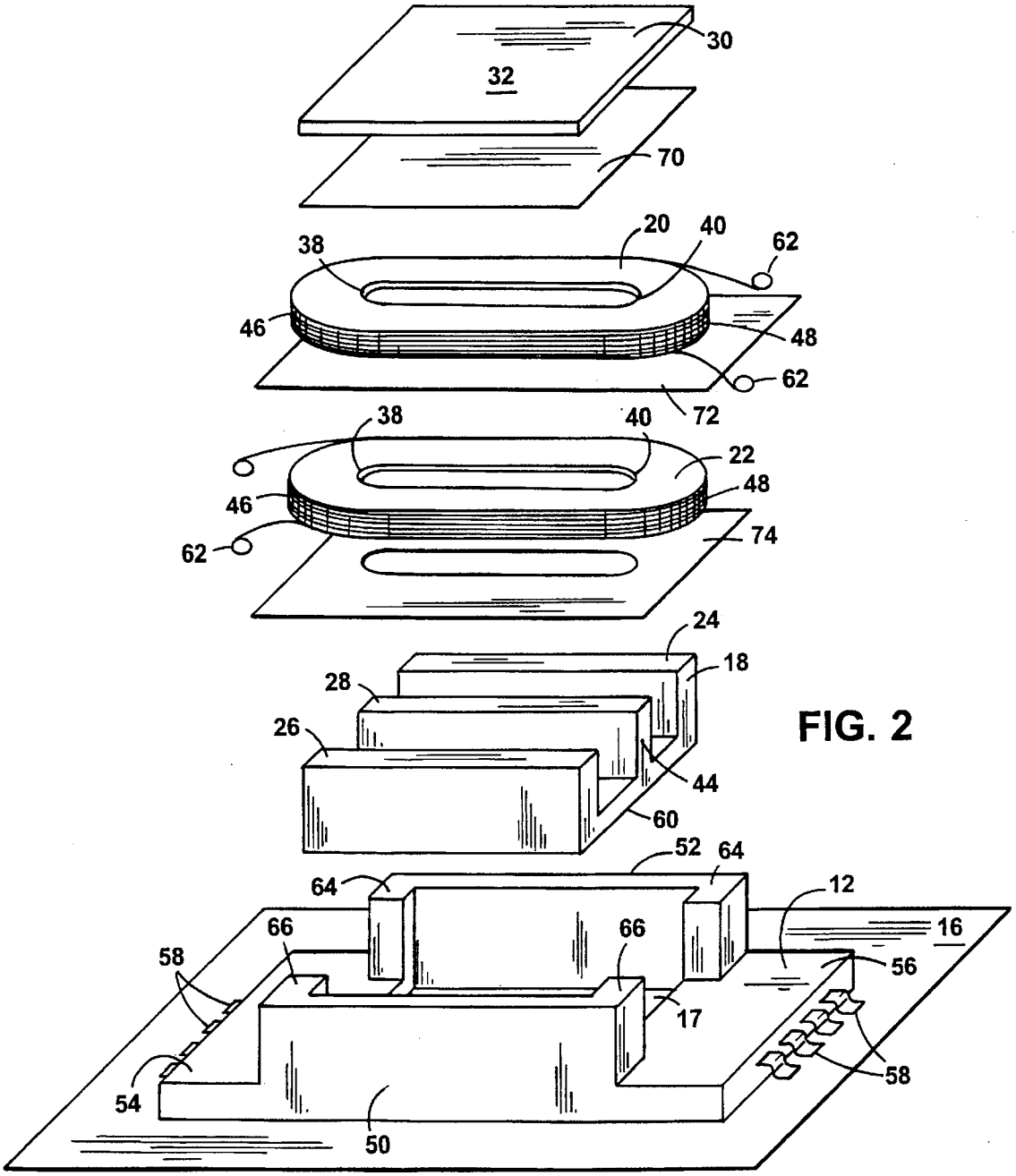
Figure 3:
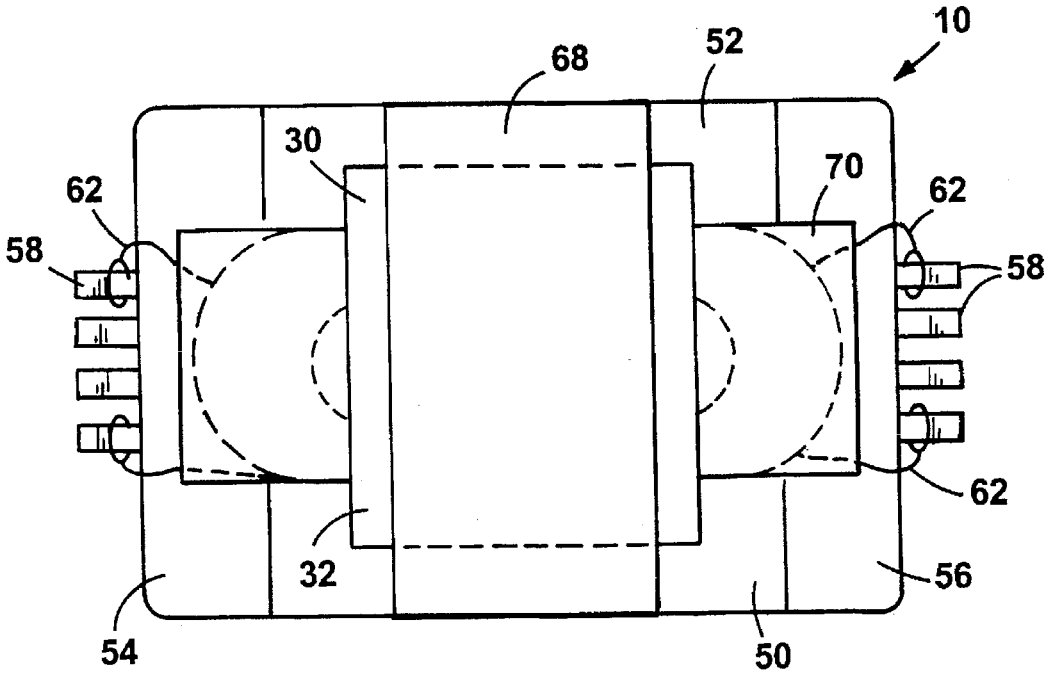
Figure 4:
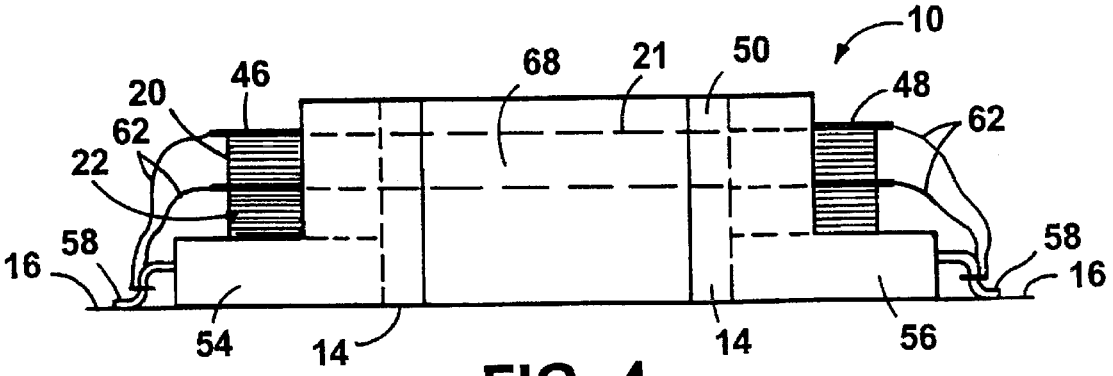
Figure 5:
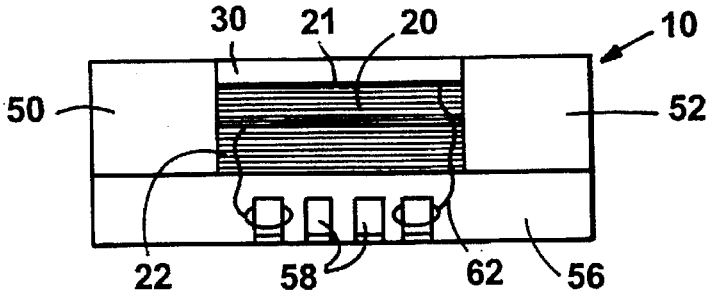

Referring to FIG. 2, the inductor assembly 10 is easy to manufacture. Inductor 14 is constructed by placing winding 22 within E-shaped core bottom 18 such that winding 22 fits around inner prong 28 of core bottom 18. Winding 20 is then placed on top of winding 22 such that winding 20 also fits within core bottom 18 and around inner prong 28. Windings 20 and 22 may be separated by insulating layer 72 such as a piece of mylar material. Insulating layer 74 may also be used to separate winding 22 and core bottom 18. Insulating layer 70 separates or gaps core top 30 and core bottom 18 and has the same planar dimensions as core top 30 to form gap 21. Once windings 20 and 22 and insulating layer 70 are in place, core top 30 is placed on top of core bottom 18. The bottom surface of core top 30 may have lips or indentations shaped complementary to walls 24, 26 and 28 for ease in placing the core top 30 over core bottom 18. Core top 30 may be sealed onto core bottom 18 with an adhesive and/or the entire inductor may be held together with one or more wrappings of mylar tape.

Inductor 14 is then placed in header 12 to form inductor assembly 10. Inward edges 64, 66 of supporting side walls 50, 52 hold inductor 14 longitudinally within the header 12. The top surfaces of the side walls 50 and 52 form a continuous flat surface with the top surface 32 of core top 30. After the inductor 14 is inserted into header 12, leads 62 are connected to their respective terminals 58. The entire inductor assembly 10 may be bound with a piece of mylar tape 68. Tape 68 may be used instead of or in addition to tape used to bind the inductor 14 itself.

First and second windings 20 and 22 are made of bondable or fusible wire in which the coating on the wire may be chemically or thermally activated (e.g., wire available from MWS Industries of Westlake Village, Calif.). The core material used for the core bottom 18 and top 30 is available from, e.g., Magnetics Inc., a division of Spang & Co., of Butler, Pa. The sizes of the core pieces may vary with the application for the magnetics. Typically, the core material is a high frequency ferrite for high frequency power conversion. Magnetics Inc. refers to such material as P-type or R-type material. Similar material is available from Ceramics Magnetics Inc. under the label MN8CX. TDK Magnetics refers to similar material as Plastron. The header 12 is made of a plastic, insulating material, preferably UL recognized plastic with a minimum flammability rating of 94 V-Z.

In one example, the core bottom 18 and core top 30 are both 0.370 wide and 0.420 long (all dimensions are in inches). The core bottom is 0.150 high and each wall 24, 26 and 28 is 0.1 high. The outer walls 24 and 26 are 0.050 wide and the inner wall is 0.090 wide. The spacing between the outer and inner walls is also 0.090, equal to the width of the inner wall. The width and height of the inner prong 28, in particular, may vary with the desired magnetic characteristics of inductor 14. The header is 0.680 long and 0.420 wide. The supporting side walls 50, 52 are 0.530 long, 0.020 thick, and 0.200 high. The side walls 50, 52 have an inner length between inward edges 64 and 66 of 0.430 and a gap between supporting walls 50 and 52 of 0.380. The inner length and the gap between walls is sufficient to securely enclose inductor 12. The header 12 may include eight terminals 58, four along edge 54, numbered 1 through 4, and four along edge 56, numbered five through eight. The inductor assembly is the same height, 0.200 inches, as the side walls 50, 52. Terminals 58 are on the order of 0.010 in depth and 0.040 in width.

An insulation sheet of Mylar or Nomex paper material is placed between the core top 30 and core bottom 18 to form gap 21. The insulation sheet is very thin, on the order of 0.003 inches. The insulation sheet is cut to the same dimensions as core top 30, 0.370 wide and 0.420 long. Other insulation sheets 72 and 74 may be placed between first and second windings 20 and 22 and between the second winding 22 and the core bottom 18. These insulation sheets are similarly 0.003 thick and are cut to fit over inner prong 28. These insulation sheets are approximately 0.270 in width and do not fit over either outer prong 24 or 26, but fit squarely over inner wall 283. These insulation sheets are as long as (and have curved ends in the same manner as) windings 20 and 22. An additional insulation sheet may be placed between insulating layer 70 and core bottom 18. This sheet has the same dimensions as insulating layers 72 and 74.

In the example, windings 20 and 22 are made of 30 AWG bondable magnetic wire and are each made of 6 turns of 3 strands of wire. The windings or coils are 0.036 high. The coils are elliptical and have an inner width of 0.096 and an inner length of 0.460. The windings 20, 22 have an inner curve radius of about 0.010 radius on both ends. The windings have outer lengths of 0.610 and outer widths of 0.256. Each winding is 0.080 thick. The coil leads are cut to length and chemically stripped with a stripper for magnetic wire (such as a Miller Stevenson, part no. MS111) to permit connection to their respective terminals. A first insulation sheet 74 is placed in the core bottom 18, followed by second winding 22, another insulation sheet 72, first winding 20, and a third insulation sheet 70. The leads 62 of winding 22 are terminated to start on terminal 1 and finish on terminal 4. The leads 62 of winding 20 are terminated to start on terminal 5 and finish on terminal 8. The core top 30 is secured to core bottom 18 using epoxy glue, such as part no. 0151 by Hysol, and two layers of tape, such as 3M's part no. 1298. The epoxy is applied to the outer prongs and any excess glue is cleaned off of the prongs. The inductor 14 is then placed in the header 12 and the assembly 10 is secured together with tape 68 using 3M's part no. 1205. The inductor is gapped to obtain an inductance of 19.5 μH±8% when measured between terminals 1 and 8 while terminals 4 and 5 are shorted together. The volume of the finished inductor is 0.057 $in^3$.

In other examples, multiple windings of other gauges may be used. For example, 4 windings, two 30 AWG and two 38 AWG windings may be used, with the two 30 AWG windings sandwiching the two 38 AWG windings. The number of windings and winding characteristics including shape, size, gauge, and number of turns will vary according to the desired application.

The individual windings may be wound by hand using a manual winding arbor assembly 100 as shown in FIGS.

Figure 9:
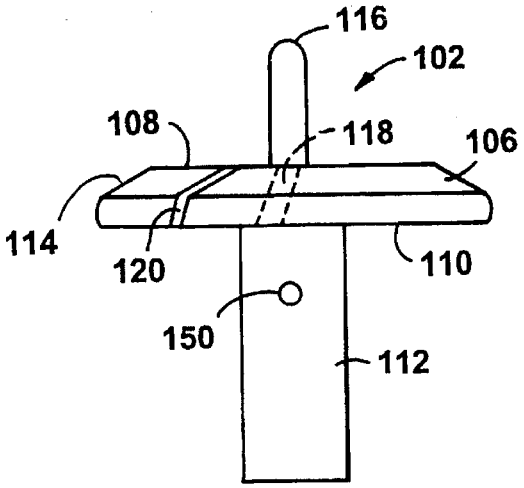
FIG. 9 is a side view of the lower portion of the arbor.
Figure 12:
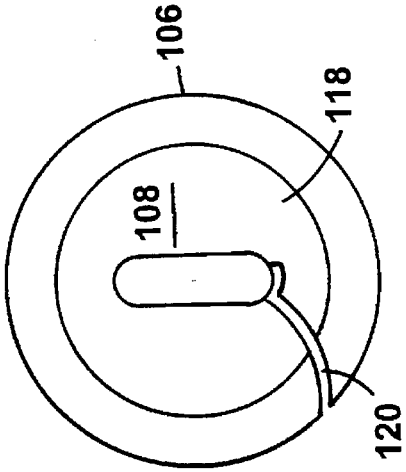
FIG. 12 is a top view of the lower portion of the arbor.
Figure 11:
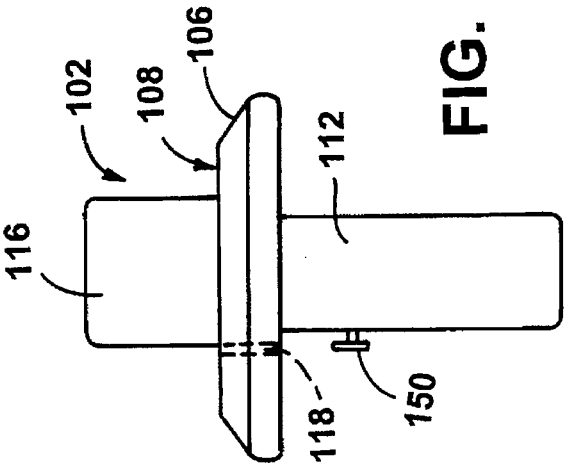
FIG. 11 is a view of another side of the lower portion of the arbor.
Figure 15:
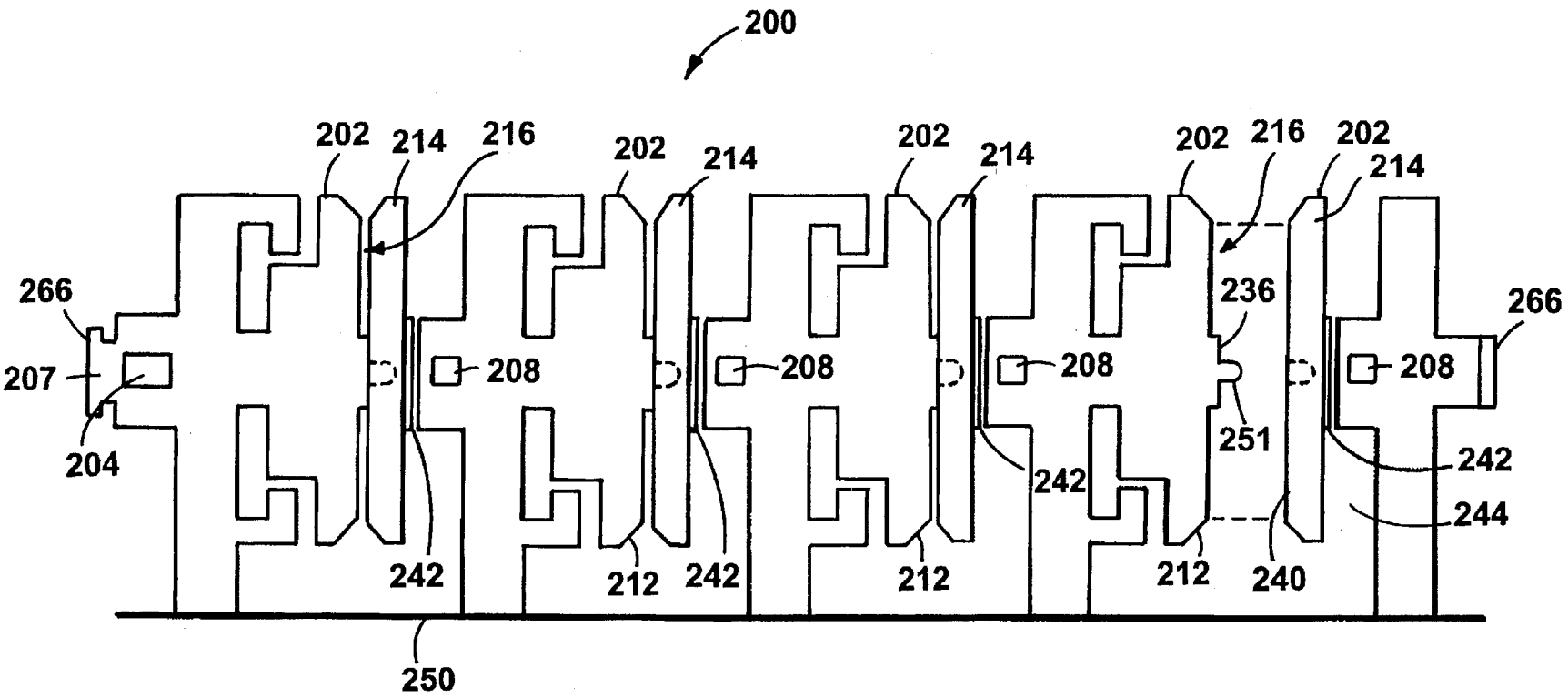
FIG. 15 is a front view of a cascaded winding arbor assembly.

8–14. The winding arbor assembly includes a lower arbor portion 102 and an upper arbor portion 104. The lower arbor portion has a tapered bottom plate 106, having a top surface 108 tapered inward from a bottom surface 110, which is perpendicular to a shaft 112 such that the tapered portion 114 extends away from shaft 112. A center post 116 extends upward from and perpendicular to bottom plate 106. Shaft 112 and center post 116 are positioned along the central axis of bottom plate 106. Referring to FIGS. 9, 11 and 12, bottom plate 106 includes an angled hole 118 positioned adjacent center post 116. Hole 118, adjacent center post 116, opens at its top end on the upper surface 110 of the bottom plate 106 and at its lower end on the lower surface of the bottom plate 106. A curved groove 120 is cut through the bottom plate 106 and extends from the hole 118 to a point along the circumference of the bottom plate 106.

Figure 14:
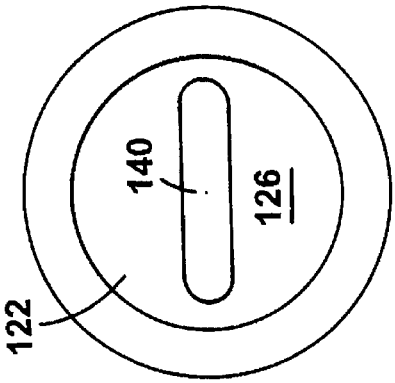
FIG. 14 is a bottom view of the upper portion of the arbor.
Figure 13:
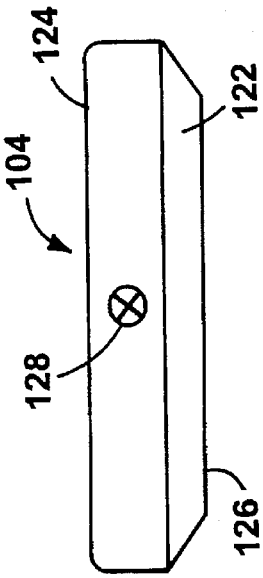
FIG. 13 is a side view of the upper portion of the arbor.

Referring to FIGS. 13 and 14, upper arbor portion 104 includes a tapered top plate 122 having a top surface 124 and a bottom surface 126. The bottom surface 126 is tapered inward from the top surface 124. The degree of taper of the tapered top plate 122 of the upper arbor portion 104 is complementary to the degree of taper of the tapered bottom plate 106 of the lower arbor portion 102. The top plate 122 includes an opening 140 which is adapted to the dimensions of center post 116 of lower arbor portion 102 so that top plate 122 may be slidably moved along center post 116. In addition, upper arbor portion 104 includes a screw and screw hole assembly 128 to fix top plate 122 at a particular position along center post 116.

Figure 10:
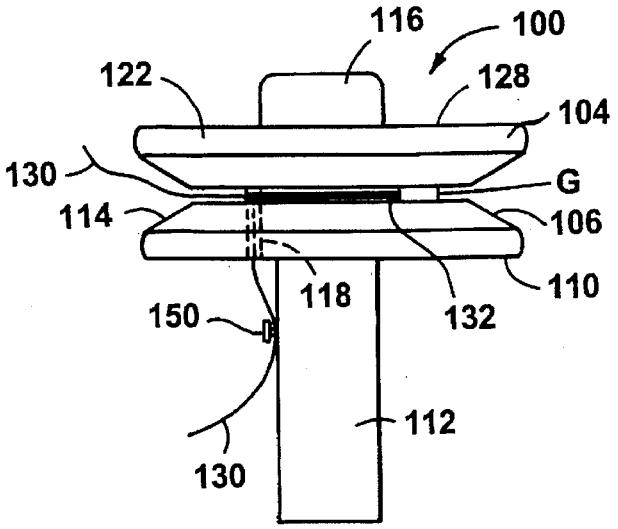
FIG. 10 is a side view of the arbor in use.

In operation, a wire 130 is threaded through hole 118 from the top surface 108 to the bottom surface 110 of bottom plate 106, and the wire 130 is secured by retainer 150 on shaft 112. The retainer 150 may be a wire loop, a clip, a clamp or another device for fixing or securing an end of wire 130 in place. Top portion 104 is slidably positioned along center post 116 so that bottom surface 126 is adjacent top surface 108 of bottom plate 106 with an appropriate gap between them. The gap size (G in FIG. 10) depends on the thickness of the desired winding 132. When the desired gap is set, top plate 122 is fixed at that position by adjusting the screw of screw hole assembly 128. Arbor assembly 100 may then be turned according to the number of turns and desired thickness of the particular winding.

The manual winding arbor assembly 100 may be rotated manually by hand or may be mounted in the chuck of a winding machine. When completed, the winding 132 may be fused electrically, chemically or thermally; then top plate 122 is removed from center post 116 and the winding may be removed from around the center post 116 and disconnected from retainer 150. Wire 130 may be stripped of its insulation prior to being secured to retainer 150. Retainer 150 may then be used for fusing winding 132.

Groove 120 allows windings to be tapped together in addition to allowing ease in threading wire onto center post 116. Thus, rather than removing a first winding from center post 116, an additional wire may be tapped to the first winding using retainer 150 and subsequently turned on center post 116. For example, one end of a first wire may be secured in place by retainer 150 and the wire is turned six times around center post 116. The wire exits through groove 120 and is terminated or snipped. Another wire may then be run through groove 120, secured in place by retainer 150 and turned six more times. With groove 120 there is no need to remove top plate 122 to thread a second wire onto arbor assembly 100. Groove 120 is angled at a degree to prevent the wire from being damaged when threaded onto arbor assembly 100. The minimum exit angle of groove 120 is about 30 degrees to keep wire from snagging or insulation from being abraded.

Preferably, the winding arbor assembly 100 is made of a high tolerance material such as anodized aluminum, stainless steel or another type of high carbon steel. The shape of the center post 116 matches the size and shape of the desired magnetic windings. The top surface 108 of lower arbor portion 102 and the bottom surface 124 of upper arbor portion 104 should be very true, flat and polished for precision in winding.

In one example, where all dimensions are in inches, the lower arbor portion 102 has a total height of 1.70 and the shaft 112 is 0.40 in diameter. Tapered bottom plate 106 is 0.20 in height, and the taper of tapered portion 114 begins at the midpoint of bottom plate 106. The bottom surface 110 is 1.35 in diameter and the top surface is 1.00 in diameter. Center post 116 has a rectangular shape and is 0.50 in height, 0.445 in length and 0.100 in width. Hole 118 is adjacent center post 116 and is angled 75 degrees from center post 116. The portion of the slot at top surface 108 is curved and has a 0.030 radius to prevent wires from snagging. Hole 118 is elliptical in shape and has a 0.040 radius at its ends. Center post 116 has a 0.025 radius at its corners.

Top plate 122 is 1.35 in diameter along its top surface 124 and 1.00 along its bottom surface 126. The top plate 122 is 0.30 high and the taper of the top plate is complementary to the taper of the bottom plate 106; the taper point is 0.10 from the bottom surface and 0.20 from the top surface. The bottom surface 126 is rounded slightly along its circumference at a 0.050 radius. The bottom surface 126 should also be flat and polished. The opening which is adapted to slide over center post 116 is 0.450 in length and 0.105 in width, and the corners has a radius of 0.025. A screw hole 128 extends at a 0.136 diameter through the upper portion, not the tapered portion, of top plate 122. A screw is tightened in screw hole 128 at a position corresponding to the desired winding size. The gap or opening between lower arbor portion 102 and upper arbor portion 104 may be precisely adjusted to 0.036 or to any desired winding size.

Individual free-standing windings may also be wound using a cascaded arbor assembly 200 (FIGS. 15–19). Cascaded arbor assembly 200 includes individual winding arbors 202 that are cascaded in series, a motor 204 at a first end 207 of winding arbor assembly 200, and a segmented shaft **206*a* and 206*b* extending from the motor 204 through each winding arbor 202. Shaft 206*a* and shaft 206*b* are separated by drive shaft 235. Shafts 206*a* and 206*b* extend through each winding arbor 202 such that each winding arbor 202 rotates along the central axis of shafts 206*a* and 206*b*. The entire arbor assembly is supported along a common surface 250 and each arbor 202 is encased by frame 252**.

Each winding arbor 202 includes a center post 210, a first arbor portion 212, a second arbor portion 214, an actuator 225, and a locking or braking mechanism 208. Shaft **206*a* extends through the first arbor portion 212, and shaft 206*b* extends through the second arbor portion 214. First arbor portion 212 includes a flat top surface 216 and has an opening at its center, the size and shape of which is complementary to the size and shape of center post 210. Center post 210 is retractably positioned through first arbor portion 212 by spring mechanism assembly 218. Spring mechanism assembly 218 includes a spring 222 within housing 220, wherein a first end 224 of spring 222 is positioned adjacent coupling 226. Coupling 226 joins center post 210 to a first end 211 of shaft 206*a*. Coupling 226 is threaded at center post end 228 and includes a retaining mechanism 232 at its other end 230. Retaining mechanism 232 is a screw such as an allen screw or a like mechanism. Retaining mechanism 232 secures first arbor portion 212 onto shaft 206***a*. When the spring mechanism is in its retracted position, center post 210 is fully retracted from first arbor portion 212.

A second end 213 of shaft 206*a* is retained by first snap ring 266. Snap ring 266 is attached to end cap 277 such that end cap 277 rotates with shaft 206*a*. Second end 213 of shaft 206*a* is rotatably connected to drive shaft 235 at its first end 237. Drive shaft 235 includes a second end 239 which is connected to segmented shaft 206*b*. Second end 239 and shaft 206*b* are separated by another snap ring 266. Drive shaft 235 is keyed to fit within the ends of segmented shafts 206*a* and 206*b* such that shaft 206*a* may slide back and force across drive shaft 235.

Center post 210 includes a keyed portion 234 at its end 236. This keyed portion is shaped complementary to keyed hole 238 of second arbor portion 214. First and second arbor portions 212 and 214 are tapered such that top surface 216 of first arbor portion 212 is complementary with top surface 240 of second arbor portion 214. Second arbor portion 214 is perpendicular to and is centered along shaft 206*b*. The shaft 206*b* is housed within frame 252. A washer or thrust bearing 242 separates the bottom surface 244 of second arbor portion 214 from frame 252.

Each arbor 202 includes an actuator 225 and a locking or braking mechanism 208. Actuator 225 is positioned along the first arbor portion 212 on frame 252. The actuator 225 is positioned toward the second end 213 of shaft 206*a* and is adapted to engage and cap 277. In one example, actuator 225 is a low profile pneumatic actuator. Additionally, each arbor 202 includes a braking mechanism 208 which is mounted along shaft 206*b* adjacent second arbor portion 214. The braking mechanism 208 may be a friction brake or a keyed slot in shaft 206*b*. The braking mechanism 208 is triggered by a pneumatic actuator or the like.

In operation, keyed portion 234 of first arbor portion 212 is mated with keyed hole 238 of second arbor portion 214. First and second arbor portions 212 and 214 are spaced apart according to the desired depth of winding 248. Wires 270 to be wound are threaded through hole 274 and are secured on retainer 272. Motor 204 spins the shaft 206 of arbor assembly 200 so that each cascaded arbor 202 rotates along the same axis and at the same speed as shafts 206*a* and 206*b*. When the desired number of turns have been completed, braking mechanism 208 is actuated and the shaft remains in a fixed position. In this position, none of the arbors 202 should rotate. Windings 248 may be fused at this point by passing an electrical current through the windings 248 to heat and fuse them.

Figure 16:
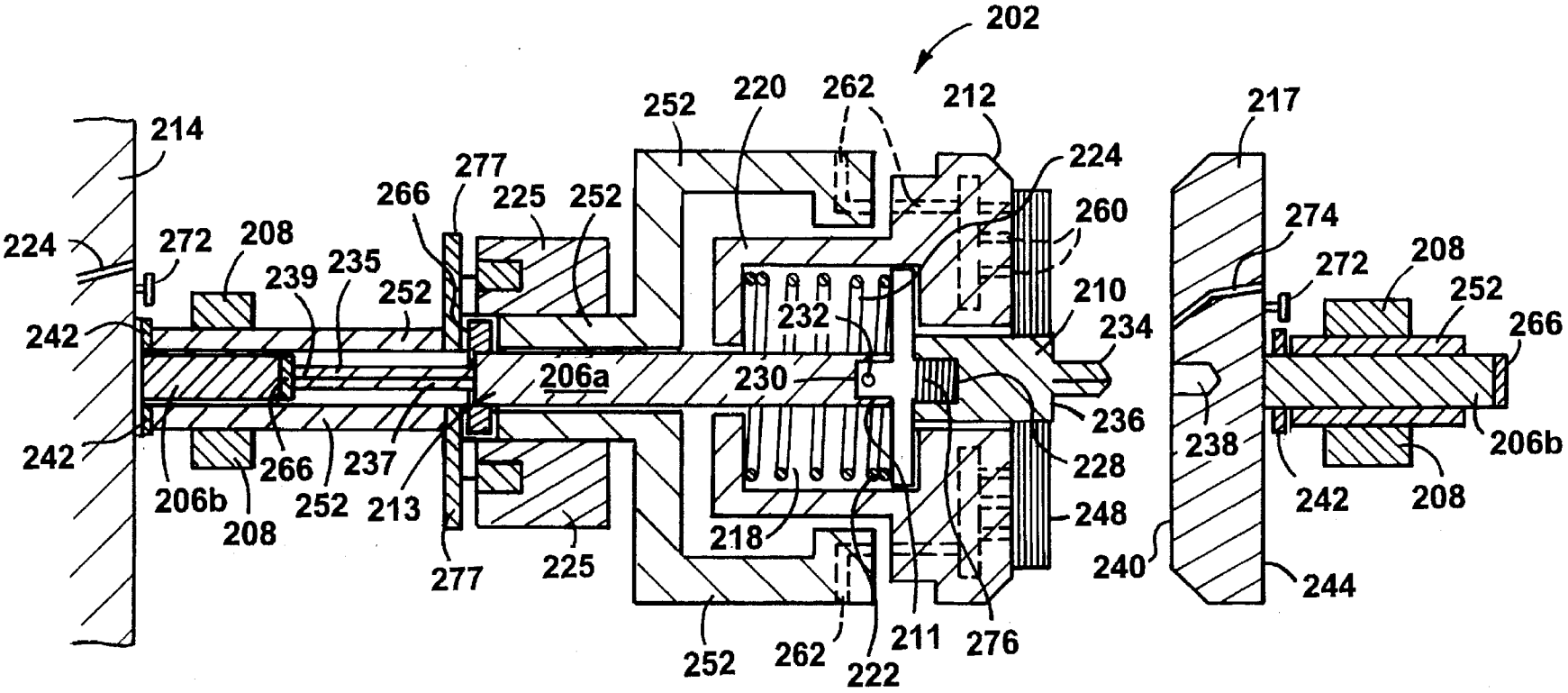
FIG. 16 is a cross-sectional view of an individual winding arbor in the arbor assembly.
Figure 18:
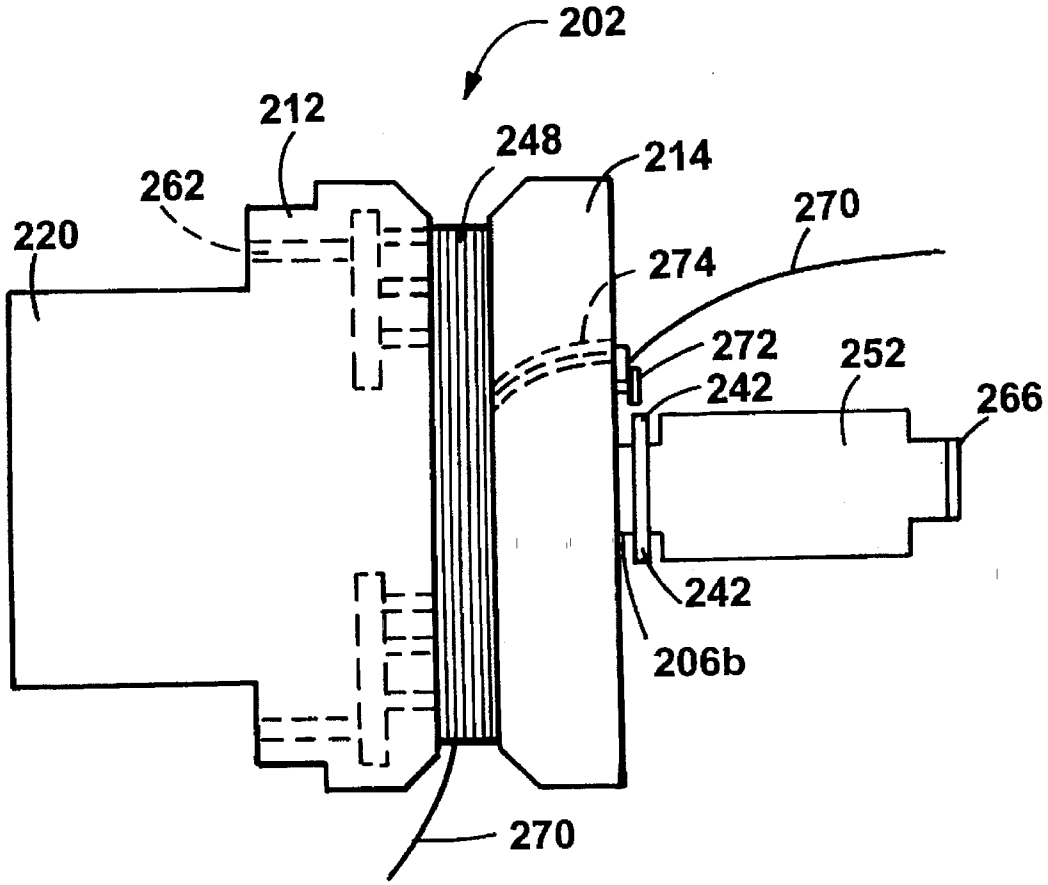
FIG. 18 is a side view of the individual arbor in use.
Figure 17:
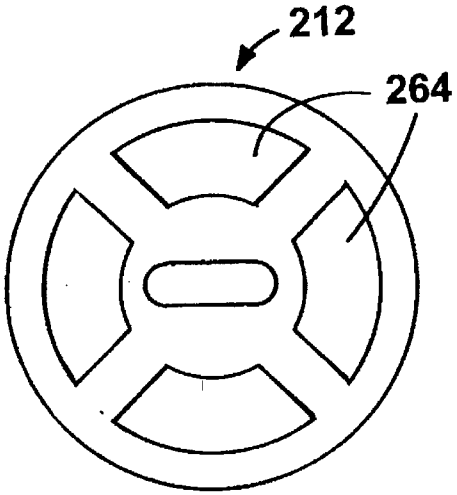
FIG. 17 is a bottom view of a first arbor portion of the arbor assembly.

Actuator 225 is engaged, which causes first arbor portion 212 to move towards end cap 277. When end cap 277 is contacted, shaft 206*a* continues its movement and causes center post 210 to retract. Shaft 206*a* slides over drive shaft 235, and housing 220 moves toward frame 252. First arbor portion 212 slides until it contacts frame 252. First and second arbor portions 212 and 214 are separated, and center post 210 is retracted to eject windings 48 from each arbor 202. In addition, as shown in FIGS. 16 and 17, other mechanisms may be used to more easily eject windings 48 such as air ports 260. Air inlets 262 may be used to blow jets of air though the first arbor portion 212. Frame 252 may also include air inlets 262. With center post 210 retracted, pressure is applied to frame 252, and air inlets 262 of frame 252 are sealed with air inlets 262 of first arbor portion 212. Air may be applied through frame 252 to eject windings. Additionally, the first arbor portion 212 may include eject feet 264 for more easily ejecting windings 248.

Once ejected, center post 210 can be returned to its normal position and subsequent wires can be secured onto center post 210 to create additional windings. To restart the arbor assembly 200 keyed portion 234 is again mated with keyed hole 238. In the event that the keyed portion and hole 234, 238 do not immediately match up, shaft 206 may be rotated until the keyed portion and hole 234, 238 mate. Only one motor 204 is needed for the assembly 200. Motor 204 is maintained at first end 207 of assembly 200. Both ends of shaft 206 are retained by a snap rings 266. Any number of arbors 202 may be serially cascaded. The center post 210 of each arbor may vary in shape and size according to the desired windings. Winding assembly 200 may be used with interchangeable first arbor portions 212. Retaining mechanism 232 is unfastened to exchange center post 210 and first arbor portion 212 for a center post and first arbor portion to accommodate the desired winding shape and size.

Other embodiments are also within the scope of the following claims.

What is claimed is:

1. A winding arbor, comprising:

two plates defining a predefined winding gap between them; and a center post extending between the two plates, one of the plates having a slot for feeding wire from one side of the one plate to the space between them, the slot configured for sequentially threading a plurality of individual wire segments onto the winding arbor without disassembly thereof, wherein the slot comprises a hole and a groove configured to prevent the wire from snagging in the slot during threading of the winding arbor, the hole extending toward a perimeter of the one plate at an acute angle relative to a longitudinal axis of the center post and the groove extending arcuately from the hole to the perimeter of the plate.

2. The winding arbor of claim 1, wherein the winding arbor comprises a material selected from the group consisting of anodized aluminum, stainless steel, high carbon steel, and combinations thereof.

3. The winding arbor of claim 1, wherein the center post is shaped complimentary to a shape desired for a winding.

4. The winding arbor of claim 1, further comprising a retainer to secure the wire to the arbor.

5. The winding arbor of claim 1, further comprising a screw and screw hole assembly to maintain the two plates in position.

6. The winding arbor of claim 1, further comprising a shaft extending opposite the center post.

7. The winding arbor of claim 6, wherein the shaft may be mounted in the chuck of a winding machine.

8. A cascaded arbor assembly, comprising:

a plurality of winding arbors each including a first and a second arbor portion having respective parallel surfaces defining a winding gap therebetween, each winding arbor further including a center post fixed on the first arbor portion, the center post and the first arbor portion being movable back and forth to mate and unmate the center post with a post receptacle in the second arbor portion, the second arbor portion having a slot configured for sequentially threading a plurality of individual wire segments onto the winding arbor without disassembly thereof; and a segmented shaft extending between the winding arbors so that the arbors are serially cascaded.

9. The cascaded arbor assembly of claim 8, further comprising an actuator for retracting the center post.

10. The cascaded arbor assembly of claim 8, further comprising a motor connected to one end of the segmented shaft for rotating the assembly.

11. The cascaded arbor assembly of claim 10, further comprising a brake for stopping rotation of the assembly.

12. The cascaded arbor assembly of claim 8, wherein the shaft is slidably connected to a drive shaft.

13. The cascaded arbor assembly of claim 8, wherein the center post moves back and forth by a spring.

14. The cascaded arbor assembly of claim 8, wherein one of the arbor portions includes air ports through which air may be blown to displace a completed winding from the first arbor portion.

15. The cascaded arbor assembly of claim 14, further comprising a frame for housing the arbor portions and the center post, the frame having air inlets adapted to mate with a pressurized air source and the air ports of the arbor portion.

16. The cascaded arbor assembly of claim 8, further comprising an actuator for separating the arbor portions.

17. The cascaded arbor assembly of claim 8, further comprising an actuator for retracting the center post and for separating the arbor portions.

18. The cascaded arbor assembly of claim 8, wherein the slot comprises a hole coupled and a groove configured for threading a wire through the second arbor to the winding gap without snagging the wire therein, the hole extending toward a perimeter of the second arbor at an acute angle relative to a longitudinal axis of the center post and the groove extending arcuately from the hole to the perimeter of the second arbor.

* * * * *

UNITED STATES PATENT AND TRADEMARK OFFICE

CERTIFICATE OF CORRECTION

PATENT NO. : 5,657,942
DATED : August 19, 1997
INVENTOR(S) : Richard A. Faulk

It is certified that error appears in the above-identified patent and that said Letters Patent is hereby corrected as shown below:

On the title page: Item [56] under the section "OTHER PUBLICATIONS", second column, line 9, please delete "-Profile" and insert --Profile--.

In col. 3, line 61, please delete "94 V-Z" and insert --94V-Z--.

In col. 4, line 55, please delete "$\mu$H±8%" and insert --$\mu$H ± 8--.

In col. 7, line 15, please delete "force" and insert --forth--.

In col. 7, line 31, please delete "and" and insert --end--.

Signed and Sealed this

Sixth Day of January, 1998

Bruce Lehman

*Attest:*

BRUCE LEHMAN

*Attesting Officer*

*Commissioner of Patents and Trademarks*